US011291904B2

(12) United States Patent
Schultz

(10) Patent No.: US 11,291,904 B2
(45) Date of Patent: Apr. 5, 2022

(54) PORTABLE PITCHING MOUND

(71) Applicant: True Pitch, Inc., Altoona, IA (US)

(72) Inventor: Randy Schultz, Sumner, IA (US)

(73) Assignee: True Pitch, Inc., Altoona, IA (US)

( * ) Notice: Subject to any disclaimer, the term of this patent is extended or adjusted under 35 U.S.C. 154(b) by 0 days.

(21) Appl. No.: 16/916,416

(22) Filed: Jun. 30, 2020

(65) Prior Publication Data

US 2020/0330848 A1 Oct. 22, 2020

Related U.S. Application Data

(63) Continuation-in-part of application No. 16/853,094, filed on Apr. 20, 2020, now abandoned, which is a continuation of application No. 16/039,539, filed on Jul. 19, 2018, now abandoned.

(51) Int. Cl.
*A63B 71/00* (2006.01)
*A63B 71/02* (2006.01)

(52) U.S. Cl.
CPC ..... *A63B 71/02* (2013.01); *A63B 2210/50* (2013.01)

(58) Field of Classification Search
CPC ..... A63B 71/02; A63B 2210/50
USPC ..... 473/497, 499, 452; D21/780
See application file for complete search history.

(56) References Cited

U.S. PATENT DOCUMENTS 3,703,285 A * 11/1972 Perry ..... A63B 69/0013 473/497
4,561,653 A * 12/1985 Wright ..... A63B 71/00 473/497
7,361,105 B2 * 4/2008 Goeders ..... A63B 69/0002 473/497
9,474,954 B2 * 10/2016 Lee ..... A63B 71/02 473/497
2004/0242352 A1 * 12/2004 Panus ..... A63B 69/0002 473/497
2013/0196797 A1 * 8/2013 Lee ..... A63B 71/02 473/497
2020/0023260 A1 * 1/2020 Schultz ..... A63B 71/02 473/497
2020/0246674 A1 * 8/2020 Schultz ..... A63B 1/00 473/497
2020/0330848 A1 * 10/2020 Schultz ..... A63B 71/02 473/497

* cited by examiner

*Primary Examiner* — Mitra Aryanpour
(74) *Attorney, Agent, or Firm* — Zarley Law Firm, P.L.C.

(57) ABSTRACT

A portable pitching mound with a plurality of mound sections. The plurality of mound sections are assembled by inserting a lower edge of one mound section into a receiving slot of another mound section. The configuration of the receiving slot forms an opening larger than the lower edge of the mound section to be received therein. The larger size of the opening allows the lower to be positioned anywhere above the opening of the receiving slot and upon lowering the weight of the mound section and gravity causes the lower edge to slide downwards and towards the adjoining mound section. Assembly does not require any tools or connection members such as screws, bolts, clamps, clasps, pins, adherent or adhesive surfaces, or the like.

4 Claims, 8 Drawing Sheets

PORTABLE PITCHING MOUND

CROSS REFERENCE TO RELATED APPLICATION

This application is a continuation-in-part of pending U.S. application Ser. No. 16/853,094 filed on Apr. 20, 2020, which is a continuation of pending U.S. application Ser. No. 16/039,539 filed on Jul. 19, 2018, the contents of these applications are hereby incorporated by reference in their entirety.

BACKGROUND OF THE INVENTION

The present invention is directed to a portable pitching mound, and more particularly, to a portable pitching mound having multiple mound sections that are easy to assemble.

Portable pitching mounds are known in the art. Larger pitching mounds, due to their size and weight, include multiple mound sections that are connected to one another. There are a number of ways that the mound sections are connected to one another. Unfortunately, these connections mean the mounds are complex, expensive to manufacture, or difficult to assemble. Accordingly, a need exists in the art for a device that addresses these deficiencies.

An objective of the present invention is to provide a portable pitching mound that is easy to assemble.

Another objective of the present invention is to provide a portable pitching mound having a connecting means that is easy and inexpensive to manufacture.

These and other objectives will be apparent to those having ordinary skill in the art based upon the following written description, drawings and claims.

SUMMARY OF THE INVENTION

A portable pitching mound having a plurality of mound sections. The mound sections have an outer edge, a top surface, and at least one inner or side wall having a lower edge.

The plurality of mound sections are assembled by inserting a lower edge of one mound section into a receiving slot of another mound section. The configuration of the receiving slot forms an opening larger than the lower edge of the mound section to be received therein. The larger size of the opening allows the lower edge to be positioned anywhere above the opening of the receiving slot and upon lowering, the weight of the mound section and gravity causes the lower edge to slide downwards and towards the adjoining mound section. Assembly does not require any tools or connection members such as screws, bolts, clamps, clasps, pins, adherent or adhesive surfaces, or the like.

DETAILED DESCRIPTION

Figure 1:
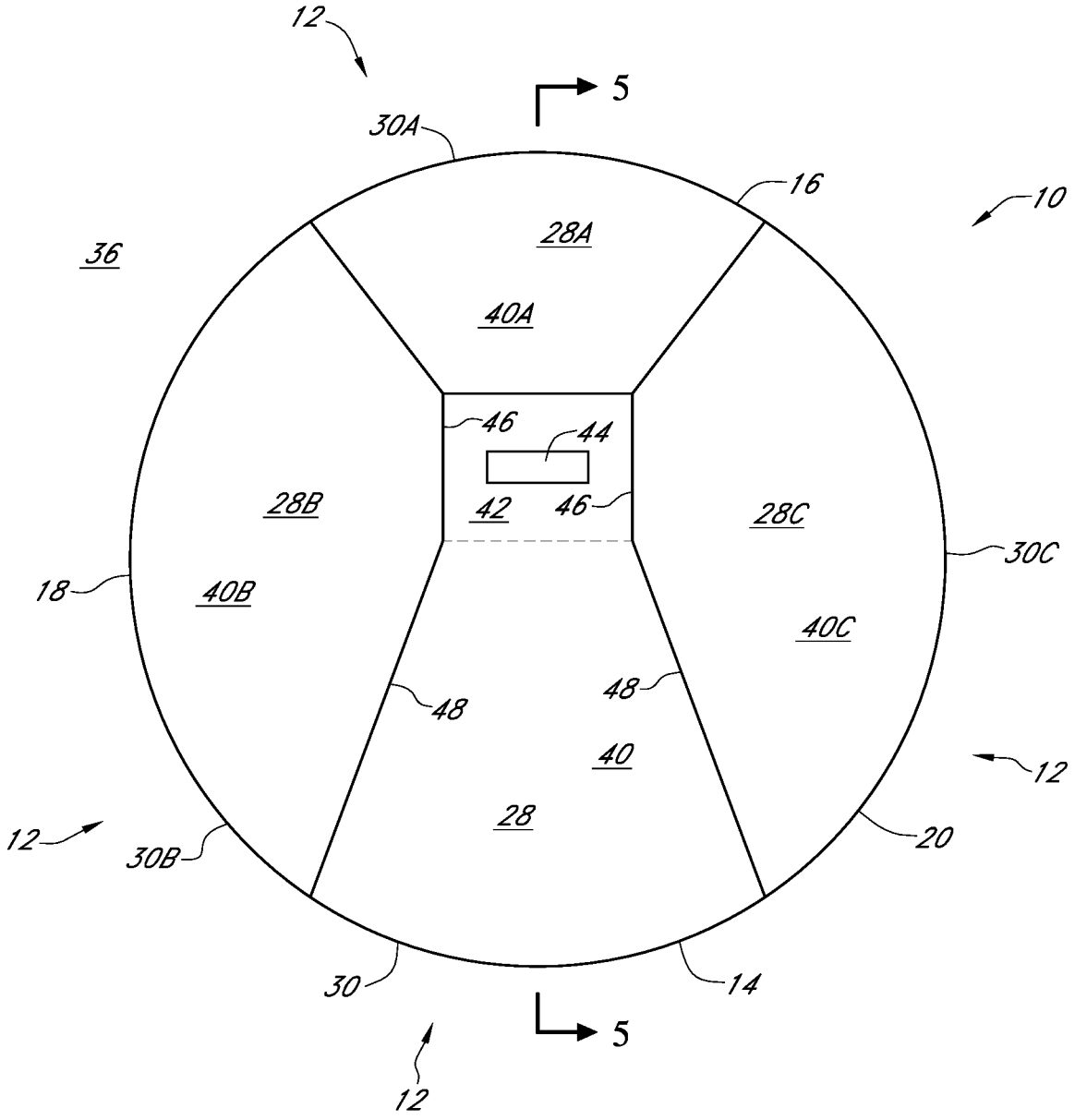
FIG. 1 is a top plan view of a portable pitching mound.

With reference to the Figures, a portable pitching mound 10 includes a plurality of mound sections 12 that are removably connected to one another, including, for example, a first section or first central section 14, a second section or second central section 16, a third section or first side section 18, and a fourth section or second side section 20. The portable pitching mound 10 may have any number of mound sections as depicted in the exemplary embodiments of the present invention showing the portable pitching mound 10 having four mound sections 12 and three mound sections 12.

The plurality of mound sections 12 are assembled and connected to form the portable pitching mound 10 by inserting a lower edge 22 of one mound section 12 into a receiving slot or channel 24 that extends upwardly and outwardly from the lower edge 22 of another mound section 12. The upward and outward extension of the receiving slot 24 forms an opening 26 that is larger than the lower edge 22 of the mound section 12 to be received therein. The larger size of the opening 26 permits the lower edge 22 of one mound section 12 to be positioned anywhere above the opening 26 of the receiving slot 24 and upon lowering the lower edge 22 of one mound section 12 into the receiving slot 24, the angle of the receiving slot 24 causes a simple assembly and secure connection between adjacent mound sections 12 due to the weight of the mound sections 12 and gravity that forces the mound sections 12 together as the lower edge 22 of one mound section 12 slides towards the lower edge 22 having the receiving slot 24. In some embodiments, the receiving slot 24 extends around the entire lower edge 22 of at least one mound section 12 which assembles with other mound sections 12 that only terminate in the lower edge 22. In other arrangements, the receiving slot 24 only partially extends around the lower edge 22 of one or more mound section 12.

Assembly of the portable pitching mound 10 does not require any connection members (not shown) such as screws, bolts, clamps, clasps, pins, adherent or adhesive surfaces, or the like. Rather, assembly is accomplished by the insertion of a lower edge 22 into a receiving slot 24 of the respective plurality of mound sections 12. Without limitation, various particular exemplary embodiments of the present invention will be discussed further in the following.

Figure 2:
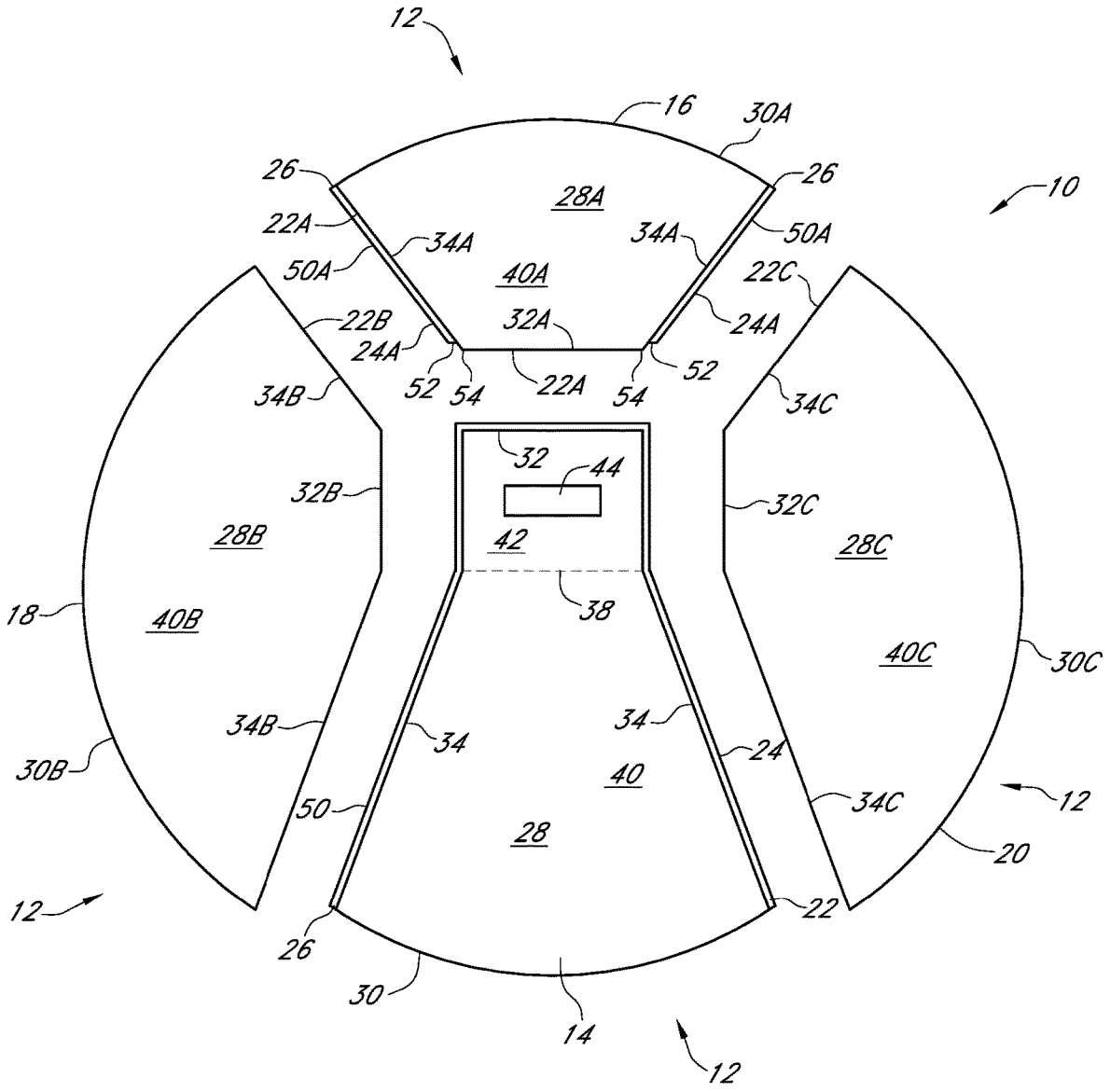
FIG. 2 is a top exploded view of a portable pitching mound.

As shown in the exemplary embodiment of FIGS. 1 and 2, the portable pitching mound 10 has four mound sections 12. The first central section 14 has a top surface 28 that extends between an outer edge or end 30 and an inner wall 32, and between a pair of side walls 34. The pair of side walls 34 extend between the outer edge 30 and the inner wall 32 and the inner wall 32 extends between the pair of side walls 34. The inner wall 32 and the pair of side walls 34 also extend between the top surface 28 and the lower edge 22 of the inner wall 32 and the pair of side walls 34. In this way, the lower edge 22 and the outer edge 30 engage a ground surface 36 when the portable pitching mound 10 is assembled for use.

As depicted in the exemplary arrangement, the outer edge 30 is arcuate in shape. The top surface 28 angles upwardly and inwardly from the outer edge 30 to a transition line or point 38 nearer the inner wall 32 such that a sloped region or portion 40 is formed. From the transition line 38 to the inner wall 32, the top surface 28 extends along a horizontal plane thereby forming a flat region or portion 42 of the top surface 28. In some embodiments, a pitcher's plate 44 is connected on the flat portion 42.

The pair of side walls 34 of the exemplary embodiment of FIG. 2, and other embodiments, have a first or straight section 46 that runs perpendicular or substantially perpendicularly to the inner wall 32. In some embodiments, the straight section 46 extends from the inner wall 32 to the transition line 38. The pair of side walls 34 also have an angled section that extends from the straight section 46 of each of the pair of side walls 34 to the outer edge 30.

The lower edge 22 of the inner wall 32 and the pair of side walls 34 have a flange or lip 50 that extends upwardly and outwardly away from the lower edge 22 to form the receiving slot 24. In this way, the receiving slot 24 is positioned to the exterior of the first central section 14.

The second central section 16, as depicted in the exemplary embodiment of FIGS. 1 and 2, has a top surface 28A that extends between an outer edge or end 30A and an inner wall 32A, and between a pair of side walls 34A. The pair of side walls 34A extend between the outer edge 30A and the inner wall 32A and the inner wall 32A extends between the pair of side walls 34A. The inner wall 32A and the pair of side walls 34A also extend between the top surface 28A and a lower edge 22A of the inner wall 32A and the pair of side walls 34A. In this way, the lower edge 22A and the outer edge 30A engage the ground surface 36 when the portable pitching mound 10 is assembled for use.

The outer edge 30A of the second central section 16 is arcuate in shape and the top surface 28A angles upwardly and inwardly from the outer edge 30A to the inner wall 32A such that a sloped region or portion 40A is formed. In some embodiments, the pair of side walls 34A extend inwardly from the outer edge 30A to the inner wall 32A.

The lower edge 22A of the pair of side walls 34A have a receiving slot 24A formed by a flange 50A. In this way, the receiving slot 24A is positioned to the exterior of the second central section 16. In this embodiment, as exemplified by FIG. 2, the inner wall 32A of the second central section 16 does not have a receiving slot 24 and instead terminates at the lower edge 22A.

To assemble the first central section 14 and the second central section 16, the lower edge 22A of the inner wall 32A of the second central section 16 is inserted into and received in the receiving slot 24 extending from the inner wall 32 of the first central section 14. To facilitate assembly, a notch or cut out 52 is formed in a lower or bottom corner 54 where each of the pair of sidewalls 34A and the side wall 32A converge on the second central section 16. Likewise, in some embodiments, the receiving slot 24A on the pair of side walls 34A terminates at the notch 52. The notch 52 permits the lower edge 22A of the inner wall 32A to set within the receiving slot 24 of the first central section 14 when assembled without the connection being prevented or inhibited due to engagement with the pair of side walls 34A and receiving slot 24A of the second central section 16. This arrangement also provides for the receiving slot 24 of the first central section 14 to run substantially continuously with the receiving slot 24A of the second central section 16.

In alternative embodiments, the arrangement is reversed such that the lower edge 22 of the inner wall 32 of the first central section 14 is received in the receiving slot 24A of the second central section 16.

The first side section 18, as shown in the exemplary embodiment of FIGS. 1 and 2, also has a top surface 28B that extends between an outer edge or end 30B and an inner wall 32B, and between a pair of side walls 34B. The pair of side walls 34B extend between the outer edge 30B and the inner wall 32B and the inner wall 32B extends between the pair of side walls 34B. The inner wall 32B and the pair of side walls 34B also extend between the top surface 28B and the lower edge 22B of the inner wall 32B and the pair of side walls 34B. In this way, the lower edge 22B and the outer edge 30B engage the ground surface 36 when the portable pitching mound 10 is assembled for use.

As depicted in the exemplary arrangement, the outer edge 30B is arcuate in shape. The top surface 28B angles upwardly and inwardly from the outer edge 30B to the inner wall 32B such that a sloped region or portion 40B is formed. In some embodiments, the pair of side walls 34B extend inwardly from the outer edge 30B to the inner wall 32B. To facilitate assembly, the angle of the inner wall 32B and the pair of side walls 34B are such that they align with one side of the first central section 14 and the second central section 16. The lower edge 22B of the pair of side walls 34A do not have a receiving slot 24 and instead terminate at the lower edge 22B.

To assemble the first side section 18 with first central section 14 and the second central section 16, the lower edge 22B of the first side section 18 is inserted into and received in the receiving slot 24 and receiving slot 24A along one of the pair of side walls 34 and 34A of the first central section 14 and the second central section 16, respectively. To facilitate assembly, a notch or cut out 52A is formed in the lower edge 22B of the first side section 18, which permits the lower edge 22B to set within the respective receiving slots 24 and 24A without the connection being prevented or inhibited due to engagement between the lower edge 22B and the receiving slot 24A of the first central section 14.

As seen in the exemplary embodiment of FIGS. 1 and 2, the second side section 20 has nearly identical structure and arrangement of the first side section 18 except mirrored, including a top surface 28C, an outer edge 30C, an inner wall 32C, a pair of side walls 34C, and a notch 52B along the lower edge 22C. Similarly, the assembly of the second side section 20 with the first central section 14 and the second central section 16 is accomplished by inserting the lower edge 22C of the second side section 18 into the receiving slot 24 and receiving slot 24A along one of the pair of side walls 34 and 34A of the first central section 14 and the second central section 16, respectively.

In alternative embodiments, the arrangement is reversed such that the lower edge 22A of the first central section 14 and the lower edge 22A of the second central section 16 are received in the receiving slot 24 extending from first side section 18 and the second side section 20.

When fully assembled, the first central section 14, the second central section 16, the first side section 18, and the second side section 20 form the portable pitching mound 10 with a circular shape due to the arcuate outer edges 30, 30A, 30B, and 30C.

Figure 3:
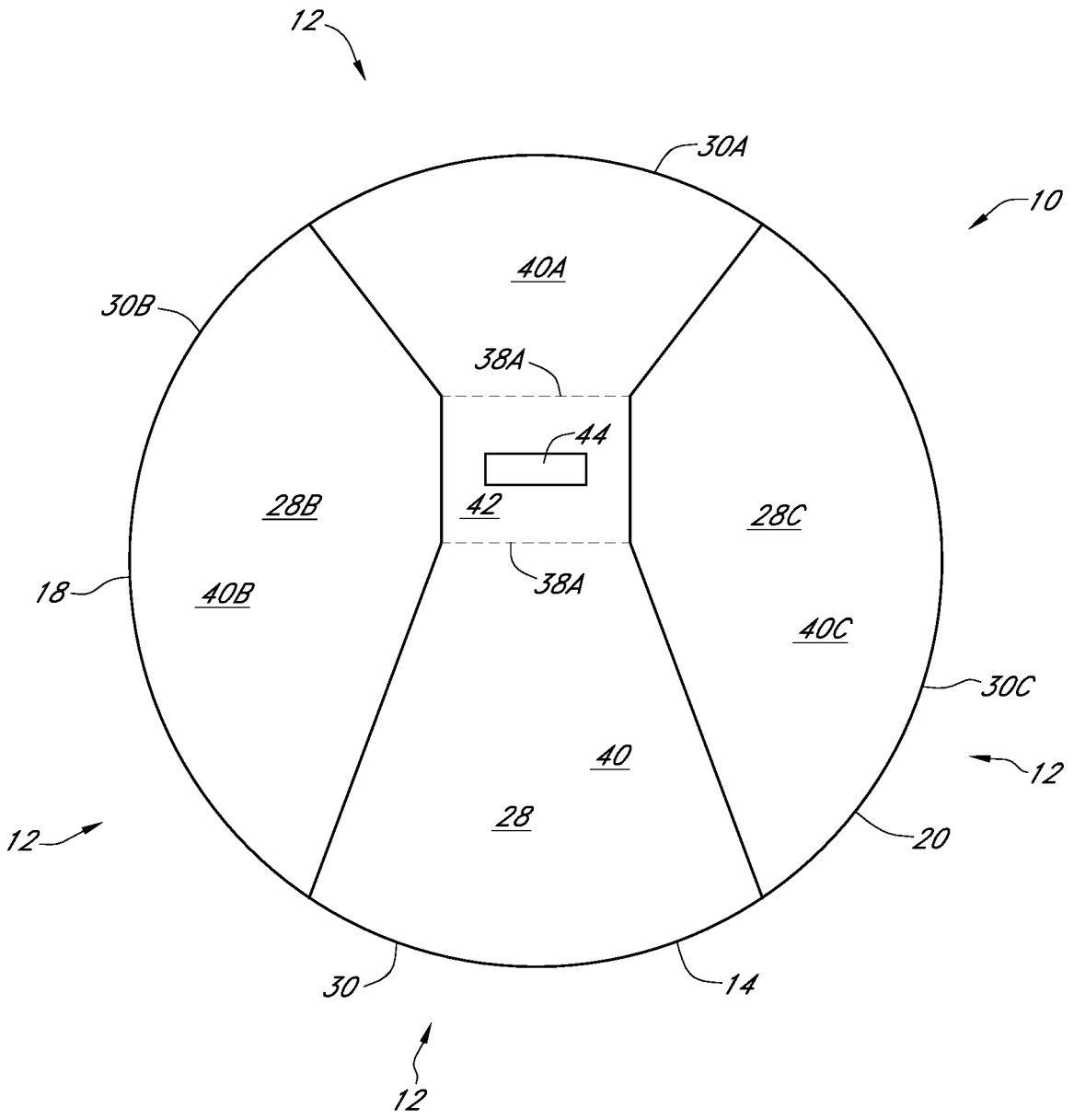
FIG. 3 is a top plan view of a portable pitching mound.
Figure 4:
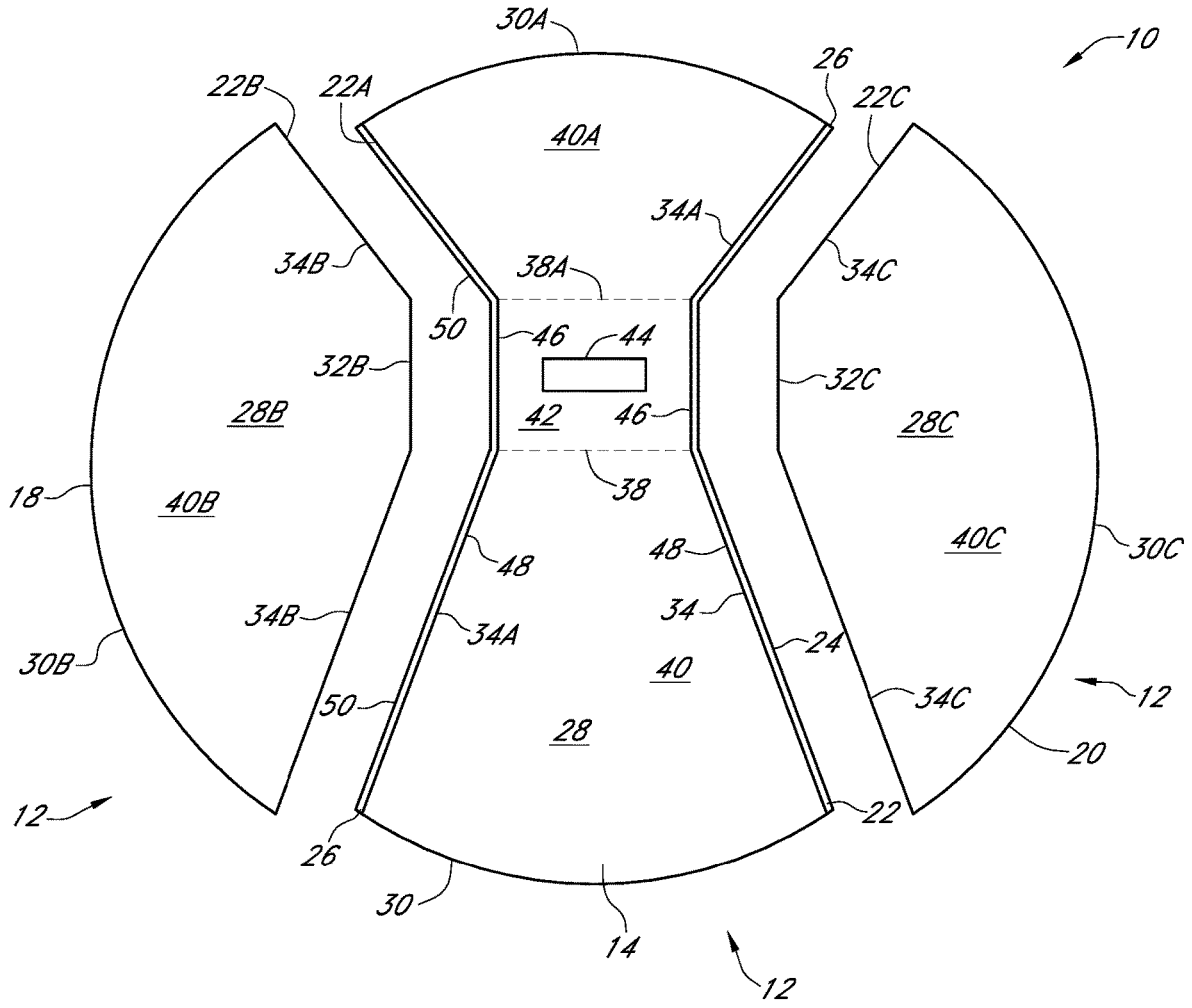
FIG. 4 is a top exploded view of a portable pitching mound.
Figure 5:
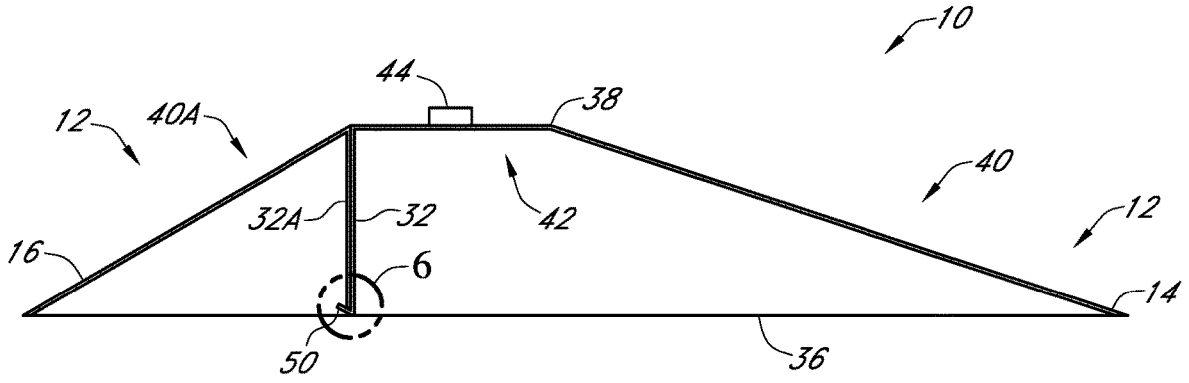
FIG. 5 is a side cross-sectional view of a portable pitching mound along line 5 of FIG. 1.
Figure 6:
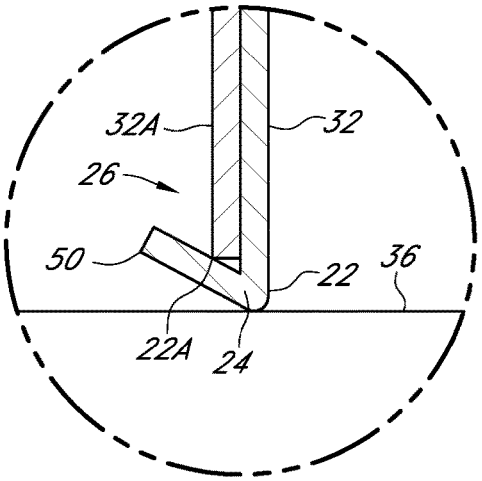
FIG. 6 is a cross-sectional view of a connection between mound sections of a portable pitching mound.
Figure 7:
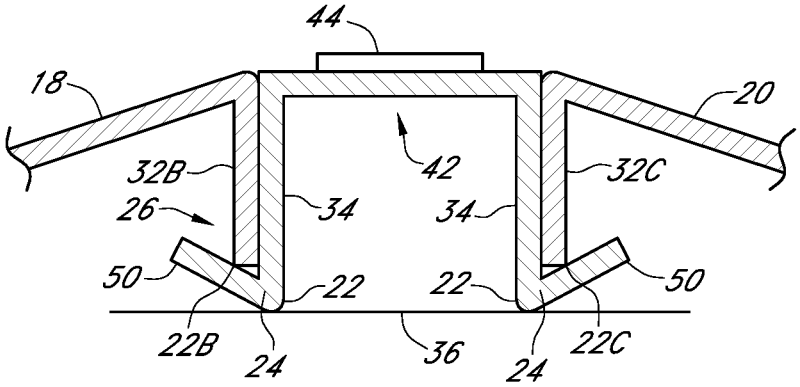
FIG. 7 is a cross-sectional view of a connection between mound sections of a portable pitching mound.
Figure 8:
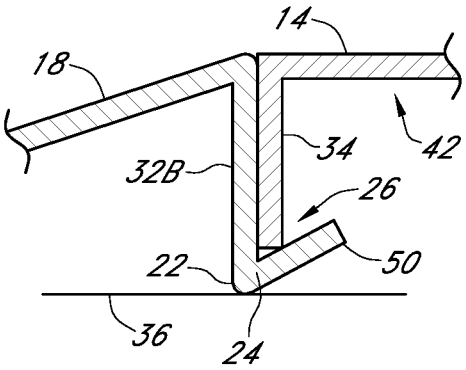
FIG. 8 is a cross-sectional view of a connection between mound sections of a portable pitching mound.
Figure 9:
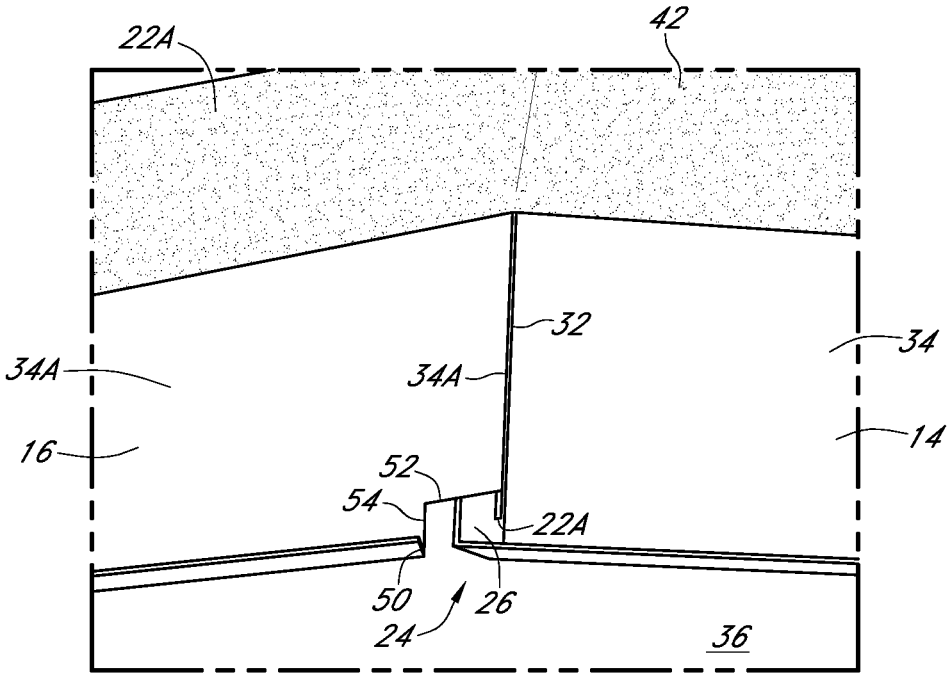
FIG. 9 is a perspective view of a portable pitching mound.

In the alternative embodiment, depicted in the example of FIGS. 3 and 4, the portable pitching mound 10 has three mound sections 12. In this arrangement, the first central section 14 and the second central section 16 are monolithically structured such that there is no need for assembly of a first central section 14 and second central section 16 with respective inner walls 32 and 32A. Rather, in arrangements of this nature, the central section 14 extends between a pair of outer edges 30 and 30A. The top surface 28 of the central section 14 has a similar configuration as the four-mound section 12 embodiment, including the presence of the slope portion 40 and the flat portion 42. In this exemplary embodiment, the top surface 28 angles upwardly and inwardly from the outer edge 30A to a second transition line or point 38A such that a second sloped region or portion 40A is formed. Between the transition lines 38 and 38A the top surface 28 extends along a horizontal plane thereby forming the flat region or portion 42 of the top surface 28.

To further facilitate assembly of the portable pitching mound 10, the plurality of mound sections 12 are monolithically formed from a one-piece construction or mold. This further negates the need for connection members or tools to accomplish the present invention. In some embodiments, the portable pitching mound 10 is molded from fiberglass to further simplify manufacturing while maintaining a durable structure that is also lightweight.

Therefore, a portable pitching mound 10 has been provided that is easy to assemble, provides a connection that is easy and inexpensive to manufacture, and improves upon the art.

From the above discussion and accompanying figures and claims it will be appreciated that the portable pitching mound 10 offers many advantages over the prior art. It will be appreciated further by those skilled in the art that various other modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. A portable pitching mound comprising:

a first central mound section having an outer edge, an inner wall, and a pair of side walls;

the first central mound section having a receiving slot that extends outwardly and upwardly from the inner wall and the pair of side walls;

a second central mound section having an outer edge, an inner wall, and a pair of side walls;

the second central mound section having a receiving slot that extends outwardly and upwardly from the pair of side walls;

wherein the first central mound section and the second central mound section are connected to one another by receipt of a lower edge of the inner wall of the second central mound section within the receiving slot of the inner wall of the first central mound section;

a first side section having an outer edge, an inner wall, and a pair of side walls;

wherein the first side section is connected to the first central mound section and the second central mound section by receipt of a lower edge of the inner wall and pair of side walls of the first side mound section within the receiving slots along one of the pair of side walls of the first central mound section and the second central mound section;

a second side section having an outer edge, an inner wall, and a pair of side walls;

wherein the second side section is connected to the first central mound section and the second central mound second by receipt of a lower edge of the inner wall and pair of side walls of the second side mound section within the receiving slots along one of the pair of side walls of the first central mound section and the second central mound section; and a lower corner of the second central mound section having a notch.

2. The mound of claim 1 wherein the receiving slot of the first central mound section is continuous along the pair of side walls and inner walls.

3. A portable pitching mound comprising:

a central mound section having an outer edge, a second outer edge, and a pair of side walls;

the central mound section having a receiving slot that extends outwardly and upwardly from the pair of side walls;

a first side section having a pair of side walls that each extend outwardly from an outer edge at an angle to an inner wall of the first side section;

wherein the first side section is connected to the central mound section by receipt of a lower edge of the inner wall of the at least one side wall of the pair of side walls of the first side mound section within the receiving slot along one of the pair of side walls of the central mound section;

a second side section having a pair of side walls that each extend outwardly from an outer edge at an angle to an inner wall of the second side section; and wherein the second side section is connected to the central mound section by receipt of a lower edge of the inner wall of the at least one side wall of the pair of side walls of the second side mound section within the receiving slot along one of the pair of side walls of the central mound section.

4. The mound of claim 1 further comprising a lower corner of the second mound section having a notch.

* * * * *